United States Patent [19]

Nelson

[11] Patent Number: 4,974,551

[45] **Date of Patent: * Dec. 4, 1990**

[54] WATER HEATER AND METHOD OF FABRICATING SAME

[76] Inventor: Thomas E. Nelson, 2407 Greten La., Anchorage, Ky. 40223

[ * ] Notice: The portion of the term of this patent subsequent to Sep. 12, 2006 has been disclaimed.

[21] Appl. No.: 389,190

[22] Filed: Aug. 3, 1989

Related U.S. Application Data

[63] Continuation-in-part of Ser. No. 311,300, Feb. 16, 1989, Pat. No. 4,865,014.

[51] Int. Cl.[5] ..... F22B 37/36

[52] U.S. Cl. ..... 122/494; 122/13 R; 126/361; 220/421; 220/410

[58] Field of Search ..... 126/361; 122/13 R, 13 A, 122/14, 17, 494; 220/420, 421, 422, 408, 410, 402; 219/312

[56] References Cited

U.S. PATENT DOCUMENTS

| | | | |
|---|---|---|---|
| 913,337 | 2/1909 | Wiffin | 220/420 |
| 970,095 | 9/1910 | McPheeters | 122/494 |
| 1,000,172 | 8/1911 | Hopkins | 220/420 |
| 1,337,278 | 4/1920 | Schulz | 220/420 |
| 1,672,904 | 6/1928 | Randall | 220/420 |
| 1,802,578 | 4/1931 | Schnepp | 122/494 |
| 2,718,583 | 9/1955 | Noland . | |
| 3,124,110 | 3/1964 | Buehl | 122/494 |
| 3,207,358 | 9/1965 | Fliss . | |
| 3,275,798 | 9/1966 | Martin . | |
| 4,372,028 | 2/1983 | Clark . | |
| 4,477,399 | 10/1984 | Tilton . | |
| 4,736,509 | 4/1988 | Nelson . | |
| 4,749,532 | 6/1988 | Pfeffer . | |
| 4,865,014 | 9/1989 | Nelson | 126/361 |

FOREIGN PATENT DOCUMENTS

| | | |
|---|---|---|
| 1454713 | 3/1969 | Fed. Rep. of Germany . |
| 2012302 | 3/1970 | Fed. Rep. of Germany . |
| 0132031 | 8/1978 | Fed. Rep. of Germany . |
| 2911880 | 10/1980 | Fed. Rep. of Germany . |
| 7507991 | 7/1975 | France . |
| 2089950 | 6/1982 | United Kingdom . |

*Primary Examiner*—Carroll B. Dority
*Attorney, Agent, or Firm*—Woodard, Emhardt, Naughton, Moriarity & McNett

[57] ABSTRACT

A water heater which may be either gas or electric and designed for use in either residential or commercial applications includes a generally cylindrical molded plastic inner water tank and a generally cylindrical molded plastic outer shell which is sized somewhat larger than the outside diameter of the tank and is disposed around the tank so as to define an annular clearance space between the shell and the tank. By means of covers and end members the clearance space between the tank and the shell are sealed closed so that a vacuum can be drawn on this closed clearance space and thereby provide thermal insulation for the inner water tank by means of the vacuum. A related construction includes a double-walled outer shell wherein the two walls are spaced apart from one another so as to define a clearance space therebetween. This clearance space is sealed closed and a vacuum drawn in order to provide the requisite insulation for the inner water tank which is disposed on the interior of the shell.

30 Claims, 9 Drawing Sheets

WATER HEATER AND METHOD OF FABRICATING SAME

CROSS-REFERENCE TO RELATED APPLICATION

This application is a continuation-in-part of my copending patent application Ser. No. 311,300 filed Feb. 16, 1989 and now U.S. Pat. No. 4,865,014.

BACKGROUND OF THE INVENTION

The present invention relates in general to water heater construction concepts and methods. More particularly, the present invention relates to the construction of water heaters out of plastic with the annular insulation space between the tank and shell being evacuated.

Conventional commercial and residential water heater construction typically includes a metal inner storage tank and an outer metal appearance/protective shell. The tank is typically made from heavy gauge metal and the shell from lighter gauge sheet metal. The tank and shell are each substantially cylindrical and arranged concentric to each other. By sizing the shell larger than the outside diameter of the tank, an annular space is created between the tank and shell allowing insulation material to be placed in the annular space for thermal insulation around the tank. Insulating material may be either fiberglass or urethane foam or a combination of an insulation blanket and foam-in-place insulation. Examples of such metal construction and foam insulation are found in U.S. Pat. No. 4,736,509 issued Apr. 12, 1988 to Nelson, U.S. Pat. No. 4,372,028 issued Feb. 8, 1983 to Clark et al., U.S. Pat. No. 4,477,399 issued Oct. 16, 1984 to Tilton and U.S. Pat. No. 4,749,532 issued June 7, 1988 to Pfeffer.

While a variety of insulation designs and material combinations have been conceived and tried, each necessitates a number of process and assembly steps in the construction of a water heater. The metal construction of tank and shell also involved a number of processing steps and some complexity of handling due to the materials and weight. It would be an improvement to conventional water heater construction to reduce the number and complexity of manufacturing steps and to reduce the material and handling costs.

Another concern exists with conventional foam insulation which is frequently employed in the annular space between the tank and shell. Even when a blanket of fiberglass is used around the lower portion of the tank, liquid foam-in-place insulation is injected into the enclosed space above the blanket of fiberglass. The use and application of such foam-in-place insulation releases fluorocarbons into the atmosphere, similar to aerosol sprays. While such releases into the atmosphere reduce the ozone layer and are thus adverse environmentally, there is an equally significant concern regarding compliance with federal regulations. In the event regulations are passed which restrict the release of fluorocarbons to the atmosphere as part of product assembly and fabrication, the water heater industry will face significant fabrication problems. In order to deal with such potential regulations, a concept to reduce the foam-in-place insulation will be required.

One embodiment of the present invention deals with the adverse release of fluorocarbons by eliminating all foam-in-place insulation from the construction of water heaters. This is accomplished by constructing the tank and shell from a molded plastic and pulling a vacuum on the annular space between these two generally concentric members. Even if regulations are not imposed and foam insulation continues to be used, plastic construction has a number of advantages from the standpoint of fabrication and material efficiencies. Since most plastic materials have a high degree of weldability and formability, there are numerous sealing configurations which can be used to retain urethane foam. Further, plastic construction precludes corrosion concerns and reduces construction and labor costs. In view of the extensive efforts in prior devices to seal the annular space for receipt of urethane foam, the elimination of costly sealing devices and structures is a great advantage in water heater construction.

The following patent references each disclose plastic construction concepts associated with water heaters and while each may disclose certain concepts and features of interest relative to the present invention, none of the references listed below are believed to be anticipatory of the present invention nor would render the present invention obvious in combination with other references.

| U.S. Pat. No. | Patentee | Issue Date |
|---|---|---|
| 2,089,950 (UK) | Duncan | 06/30/82 |
| 3,275,798 | Martin | 09/27/66 |
| 3,207,358 | Fliss | 09/21/65 |
| 2,718,583 | Noland | 09/20/55 |
| DL0132031 (German) | Forste | 08/16/78 |
| 1,454,713 (German) | Benkert | 03/20/69 |
| 2,012,302 (German) | Kaltenecker | 03/14/70 |
| 2,911,880 (German) | Burkardt | 10/02/80 |
| 7507991 (French) | | 07/11/75 |

The U.K. patent discloses a thermally insulated container, such as a domestic hot water heater, which includes a double-walled plastic tank sealed closed by a double-walled annular plastic end cover. A plurality of spacers are used between the two walls of the tank to support the inner wall from the weight of the water contained therein. The space between the two walls is evacuated to provide thermal insulation. Spacers are also used between the two walls of the end cover. An electric heating element is disposed in the lower volume of the tank and a float controls the entry of water into the tank via a cooperating water inlet pipe. There is also a water outlet pipe and an overflow pipe, all of which communicate with the interior of the tank by passing horizontally through the double side wall of the tank. This device is not pressurized and thus would not be suitable for use in the U.S. in view of the conventional water pressures which exist.

Martin discloses a domestic electric appliance configured as a water heater wherein the tank is defined by a double thickness of material including a generally cylindrical sheet metal or other suitable material for the outer wall and a layer of cellular plastic foam on the inside of the sheet metal shell. It is intended that the plastic foam have good insulating qualities and include some type of impervious skin on the innermost surface which will be the surface in direct contact with the water in the tank. This particular structure is not a plastic tank and plastic shell combination, nor is there any cavity to be evacuated.

Fliss discloses a water storage tank which is configured with an outer steel wall which is coated with a resin liner which includes an inner layer bonded to the outer wall and an outer layer which is bonded to the inner layer. Again, this particular device does not include a plastic construction and a double wall design where the annular space between the tank and the shell is evacuated.

Noland discloses the construction of a reinforced plastic water heater tank which is formed by helically winding sequentially-setting-plastic-impregnated glass-fiber "roving" cords over and around convex tank heads and helically around a cylindrical lining shell connected therebetween. This particular reference focuses specifically and primarily on the fabrication technique to simply construct a plastic hollow cylinder. Noland does not relate to plastic tank and shell designs for water heaters wherein the annular space between the shell and tank is evacuated.

The German patent of Forste discloses a hot water tank with a plastic inner liner. This plastic liner is clamped onto its flanged base by a metal adapter ring. The heating coil is housed inside a protective shell with a temperature sensor along side. The water supply pipe terminates inside the shell. This particular device does not include a double-walled construction wherein the space between the two walls is evacuated.

The German patent to Benkert discloses a hot water source with a sealed inner tank of a plastic foil and a foam insulating body which surrounds the inner tank. This particular structure does not include a double-wall configuration where the tank is plastic, the outer shell is plastic and the annular clearance space between the two is evacuated.

The German patent to Kaltenecker discloses a water heater which includes a blow-molded plastic tank with mountings which are configured as hollow mushroom-shaped keys which are engaged into a slightly smaller hole in a rear wall plate. While the primary focus of this particular reference is on this method of mounting, it is also important to note that the plastic tank is not a double-walled construction and there is no annular space present which could be evacuated in accordance with the present invention.

The German patent to Burkardt disloses a heat storage tank of rectangular cross section for the storage of liquid which is designed to work in conjunction with a solar heat collector system or a heat pump. The storage tank is made of plastic with a high temperature resistance and a low heat conductivity such as polypropylene or polyethylene. This storage liquid is not pressurized and its pressure is merely the static head. An input heat exchanger in the form of a coiled tube is arranged near the bottom with output heat exchanger near the top. Again, this particular design does not include the plastic construction of tank and shell with an evacuated annular clearance space therebetween.

The French patent discloses a storage type water heater which is heated electrically and which consists of a plastic cylinder with plastic end plates. The heater has a horizontal cylindrical body which is made of a plastic material and which is rigid and a poor conductor of heat. This particular structure does not include a double-walled construction with plastic for the tank and a plastic construction for the outer shell with an evacuated annular space therebetween.

SUMMARY OF THE INVENTION

A water heater according to one embodiment of the present invention comprises a generally cylindrical molded plastic inner water tank, a generally cylindrical molded plastic outer shell which is disposed circumferentially around and spaced outwardly from the inner water tank such that the outer shell and water tank define therebetween an annular clearance space and wherein the invention further includes enclosing means cooperatively arranged with the outer shell and with the inner water tank so as to seal closed the annular clearance space such that this annular clearance space may be maintained at a negative pressure.

One object of the present invention is to provide an improved water heater.

Related objects and advantages of the present invention will be apparent from the following description.

DESCRIPTION OF THE PREFERRED EMBODIMENT

Figure 1:
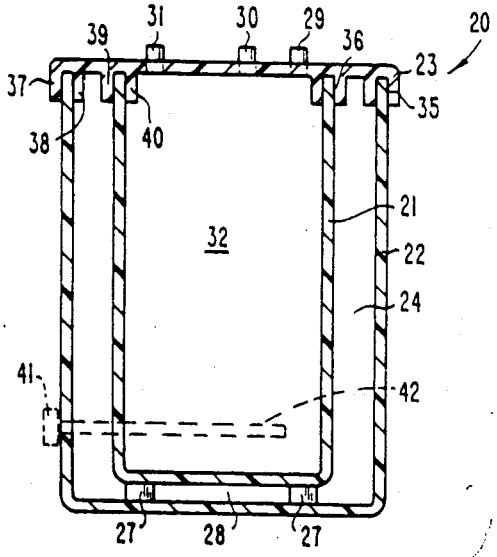
FIG. 1 is a front elevational view in full section of a hot water heater constructed of plastic according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated water heater 20 which is constructed virtually entirely of plastic with the exception of any associated heating elements and electrical controls. While the range of acceptble synthetic materials for water heater 20 is extensive, it is important to select a synthetic (plastic) material which can be cast or molded into curved and intricate shapes while holding relatively precise tolerances and dimensions. It is also important that the material utilized for water heater 20 be receptive to various adhesive compounds for attaching and joining synthetic components together and that the selected material be suitable for spin-welding, ultrasonic welding, and other frictional type welding methods.

More particularly, water heater 20 includes molded inner tank 21, molded outer shell 22 and molded top cover 23. Tank 21 and shelf 22 are each fabricated as substantially cylindrical members and are arranged relative to teach other in a generally concentric manner so as to define an annular space 24 therebetween whose radial thickness is substantially the same throughout.

In the illustrated embodiment, tank 21 and shell 22 are spaced apart from each other along their respective lower surfaces and that spacing is maintained by supports 27. Offset space 28 between the lowermost or bottom surfaces of tank 21 and shell 22 provides an area for insulation in order to reduce heat transfer from the bottom surface of the tank. Space 28 may be substantially the same thickness as annular space 24, though it is not required that these two clearance spaces be identical, only that they provide sufficient separation between the tank and shell for adequate insulating.

As would be known in the industry, the area between the tank and shell may be provided with fiberglass or urethane foam insulation or a combination of the two as detailed in the Background of the Invention. However, the primary insulation technique of the present invention is to pull a vacuum on the clearance space between the tank and the shell and simply allow this evacuated volume to serve as the means of insulation without the need to add any fiberglass or urethane foam. Virtually any opening at any point the shell or top cover may be provided for pulling the vacuum and thereafter sealed.

Although a primary focus of the present invention is the creation of a vacuum or negative pressure in the air space that surrounds the water tank, this space may alternatively be filled with a suitable thermal insulating material. This air space may be created in a number of ways as disclosed herein, and an important aspect is the use of plastic or a similar synthetic material in order to be able to achieve sealed joints and seams so that the vacuum can be maintained. Although options of either pulling a vacuum or filling the space with insulation material may not be specifically mentioned with each and every embodiment and variation described hereinafter, it is to be understood and it should be clear that either option can be used with each and every embodiment and variation of the present invention.

FIGS. 1–20 illustrate embodiments of the present invention where there is a vacuum or negative pressure established in the sealed air space. FIGS. 21–26 illustrate embodiments of the present invention where there is thermal insulating material 19 disposed in this sealed space. FIGS. 21–26 are intended to represent that situation where only thermal insulating material is disposed within the annular clearance space as well as those situations where both thermal insulating material is disposed in that space and the space is maintained at a negative pressure, a combination which is described hereinafter. It should be understood that the illustrations of these embodiments are the same whether it is only insulation material within the annular clearance space or both insulation material and a negative pressure since the negative pressure cannot otherwise be illustrated. It should further be noted that FIGS. 21–26 are not separately described since the only change from their corresponding earlier figures which are described in detail is the addition of thermal insulating material 19.

There is one further variation which is important and which also applies to each embodiment and variation described herein. This further variation is a combination of pulling a vacuum and filling the annular space with thermal insulating material. The process begins with a suitable connection to the annular space by a hose or tubing or similar fitting so that a vacuum can be pulled by a pump or some suitable suction means. Next the annular space around the inner water tank is filled with some thermal insulating material and as the insulating material is installed, a vacuum or negative pressure is pulled such that the two events occur at least in part simulataneously. The foregoing reference to "at least in part" is intended to convey the fact that a majority of the annular space may be filled with insulation before the vacuum is pulled and that the two events do not have to begin and end precisely simultaneously.

If the thermal insulating material is fiberglass or cellulose or similar fiber or particulate material, the presence of a vacuum (negative pressure or reduced atmospheric pressure) in combination with the thermal insulating material provides certain benefits. One advantage of this combination is that the insulating material may be included for strength to the shell side wall so that as the vacuum is drawn, there is added strength internally to maintain the shape and integrity of the outer shell. This is particular advantageous when the shell may be of relatively thin material which might have a tendency to deflect. Another advantage of the combination of thermal insulating material in the dry or particulate form in combination with a reduced atmospheric pressure or negative pressure (vacuum) is that a higher "R" value is able to be created. A third advantage is that if in the field due to handling damage or other problems, the vacuum to the annular space is lost, there will still be insulating material disposed in the space to provide a reasonable level of thermal insulation.

If the thermal insulating material is a liquid, foam-in-place insulation material, the presence of a reduced-atmospheric pressure or negative pressure (vacuum) results in a different cell structure with greater uniformity as to density and a lower density. In addition to the advantage of having the insulation material in the annular space in the event the vacuum is lost at some subsequent point in time, the use of a vacuum in combination with the liquid, foam-in-place insulation material allows the assembly personnel to adjust the foaming of the insulation material so as to achieve a complete fill with greater uniformity. A frequent problem with liquid, foam-in-place insulation material is the ability to control the foaming so that there is a complete fill of the space without an overfill and the resultant clean-up problems. There is also frequently a variation in the density from the initial foamed point to the ending foamed point and the use of a vacuum provides greater uniformity to the density throughout the fill. As the insulation is foaming from a liquid state to a foam state and filling the annular space, as it begins to approach the fill limit, the amount of vacuum can be reduced so as to slow down the foaming process. By varying the amount of negative pressure pulled on the annular space it is possible to precisely control the fill level of the foam in each application.

Continuing with description of the water heater of FIG. 1, it is to be understood that supports 27 may be molded as either part of tank 21 or molded as part of shell 22 or fabricated initially as separate components and then adhesively joined or welded into position. Top cover 23 is molded with three generally cylindrical openings 29, 30 and 31 which extend through the top cover and open into the interior space 32 of tank 21. Each of the openings 29, 30 and 31 have an upwardly extending substantially cylindrical portion which is used for external fittings such as a threaded connection as would be well known. Opening 29 provides a water inlet to the tank, opening 30 is a water outlet for flow from the tank and opening 31 is a pressure-relief valve.

Top cover 23 includes a pair of generally cylindrical outer grooves 35 and 36 which open downwardly and which are defined by downwardly depending and generally cylindrical ribs 37, 38, 39 and 40. Ribs 37 and 38 define channel 35 and ribs 39 and 40 define channel 36. While all of the ribs and channels are generally cylindrical and substantially concentric to each other, channels 35 and 36 are positioned so as to be in accurate alignment with the wall of shell 22 and tank 21, respectively. As illustrated, the upper cylindrical edge of shell 22 fits snugly up within channel 35 and this portion of the outer shell is overlapped and sandwiched by ribs 37 and 38. A similar assembly configuration exists with regard to the upper generally cylindrical edge of tank 21 which fits up within channel 36 and is snugly sandwiched between ribs 39 and 40. It is envisioned that top cover 23 will be securely joined to both the tank and the outer shell by a spin-welding technique or by other frictional type welding methods. An alternative assembly concept is to adhesively bond the top cover to the upper cylindrical edges of the outer shell 22 and tank 21, though the spin-welding technique is likely a more secure and integral assembly approach and thus is preferred.

The remaining component illustrated in FIG. 1 in association with water heater 20 is the electrical unit provided for heating the water within the tank and this electrical unit includes control portion 41 and heating element 42. In the illustrated embodiment, the control portion 41 is disposed on the exterior surface of outer shell 22 and the heating element extends through the wall of shell 22 and through the wall of tank 21 so as to be disposed on the interior of the tank.

With regard to the FIG. 1 illustration, a couple of other variations need to be introduced. As illustrated, the top cover fits directly over the upper open ends of both the shell and the tank. It is an option to provide a tank which is completely enclosed as a separate component with the exception of the water inlets and outlets and pressure relief and thereafter place this completed tank within the shell. When this approach is followed the top portion of the water heater will have a top cover or surface associated with the shell and a separate top surface or cover portion associated with the tank. It is thus a possibility to provide along this top surface spacers such as supports 27 and thereby establish an air space between the top surface of the tank and the top surface of the shell such that a vacuum may be pulled in this air space for insulating the top surface of the tank. This particular concept can be appreciated from the structure illustrated in FIG. 4.

Figure 2:
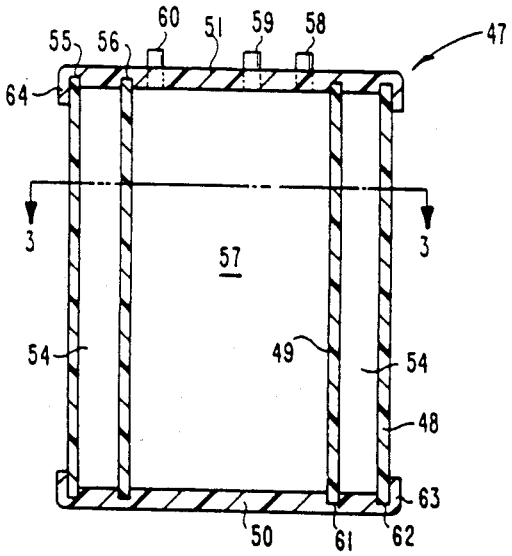
FIG. 2 is a front elevational view in full section of an alternative plastic water heater according to a typical embodiment of the present invention.
Figure 3:
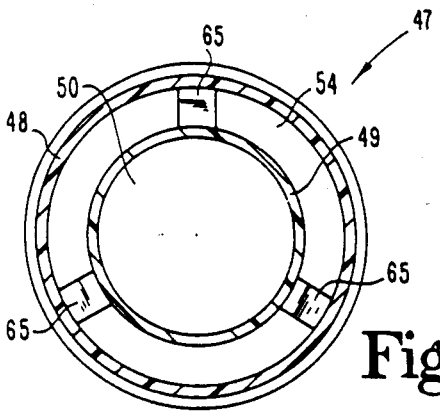
FIG. 3 is a top plan view in full section of the FIG. 2 water heater showing internal supports.

Referring to FIGS. 2 and 3, a further construction alternative for the present invention is illustrated. Water heater 47 includes an outer generally cylindrical wall 48, an inner generally cylindrical wall 49, a lower generally circular enclosing wall 50 and a top cover 51.

Outer and inner walls 48 and 49 are arranged relative to each other in a generally concentric manner so as to define therebetween an annular space 54 having a generally uniform radial thickness throughout. The attachment of outer wall 48 to bottom wall or panel 50 and of inner wall 49 to bottom wall or panel 50 is envisioned as being accomplished in being one of three primary ways. For this reason, the intersection of the outer wall to the bottom wall and of the inner wall to the bottom wall is defined by a broken line intending to indicate that the outer wall 48 and the bottom wall 50 may be fabricated, such as by molding, as a unitary, integral member and thereafter the inner wall 49 is attached with either adhesive or preferably by a suitable spin-welding technique or other frictional welding method. As an alternative, inner wall 49 can be integrally molded with bottom wall 50 as a unitary member and thereafter the outer wall 48 is attached either by a suitable adhesive or preferably by a suitable spin-welding technique or other frictional welding method. The third alternative is to fabricate bottom wall 50 as a separate and independent component part and thereafter attach both inner wall 49 and outer wall 48 to the bottom wall by either the use of a suitable adhesive or preferably by a suitable spin-welding technique.

Although the composition of water heater 47, being of a plastic or synthetic construction as well be consistent throughout the description of the present invention, begins as simply a concentric pair of generally cylindrical sleeves. When the bottom wall and top cover are assembled, these sleeves are converted into an inner tank and an outer shell generally consistent with the structure of FIG. 1. As detailed with regard to FIG. 1, the top cover has a pair of concentric and generally cylindrical, downwardly opening receiving channels 55 and 56 which are disposed up in the undersurface of top cover 51. Cylindrical channel 55 receives the upper top cylindrical edge of outer wall 48 while channel 56 receives the upper cylindrical edge of inner wall 49. Also included as part of top cover 51 and extending through the cover as necessary for communication with the interior 57 of the tank are water inlet 58, water outlet 59, and pressure relief 60. A heating element as required for electric water heaters can be installed through top cover 51 or through bottom wall 50.

As a further variation to the water heater construction of FIG. 2, it should be understood that the bottom wall 50 can be configured somewhat similarly to top cover 51. In this regard, it is envisioned that upwardly opening, concentric and generally cylindrical receiving channels 61 and 62 may be formed in the thickness of bottom wall 50 so as to receive securely the lower, generally cylindrical edges of inner wall 49 and outer wall 48, respectively. Since channels 61 and 62 are not necessarily requirements for the construction of water heater 47, they have been illustrated only in broken line form so as to indicate a construction option. In the event an upwardly opening receiving channel 62 is desired for outer wall 48, then an added thickness of material will be required on the outer surface such as upwardly extending outer flange 63 so as to provide sufficient material thickness and support for the creation of channel 62. A similar outer flange 64 is included as part of top cover 51.

A final aspect of the construction of water heater 47 is illustrated in FIG. 3 wherein a plurality of axial support ribs 65 are provided between the inner and outer walls and are rigidly attached thereto for strength, bracing and stability and as a means to maintain the generally concentric alignment of inner tank 49 and outer tank 48.

Figure 4:
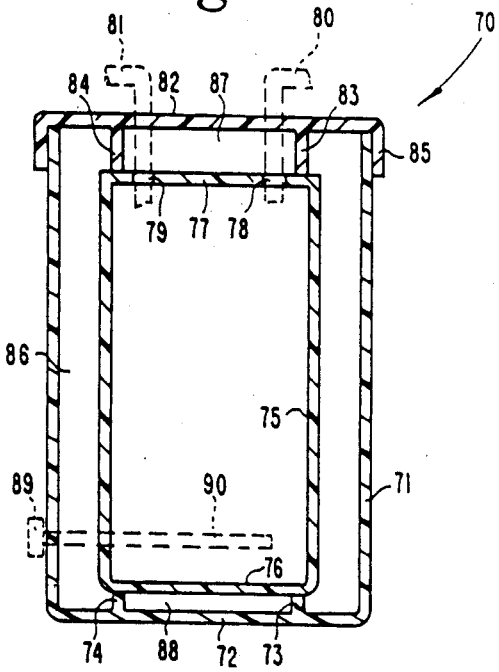
FIG. 4 is a front elevational view in full section of an alternative water heater construction according to a typical embodiment of the present invention.

Referring to FIG. 4, a further arrangement for the construction of a plastic water heater 70 is illustrated. Water heater 70 includes an outer shell 71 which is of a molded plastic construction and includes in a unitary and homogeneous fashion bottom wall 72, first support 73 and second support 74. It should also be understood that supports 73 and 74 similar to earlier described supports 27 in FIG. 1 may exist in virtually any number and may take on any shape. The support could be arcuate sections extending around a majority of the bottom surface of the tank or there could be a series of such supports on equal spacing arranged circumferentially so as to support the tank at a plurality of generally evenly spaced locations. Disposed within outer shell 71 is inner tank 75 which is a generally cylindrical member which is molded of plastic and includes a generally circular bottom wall 76 and a generally circular top wall 77 which is fitted with clearance opening 78 and 79 for water inlet 80 and water outlet 81, respectively. A pressure relief valve may also be included through the top wall. Completing the molded plastic construction of water heater 70 is top cover 82 which is of unitary and homogenoeus construction including top supports 83 and 84 and downwardly depending outer overlapping lip 85. By means of support 73, 74, 83 and 84, and by the generally cylindrical and concentric sizing of shell 71 and tank 75, an interior clearance space is provided completely around tank 75. This clearance space includes generally cylindrical annular space 86 which has a uniform radial thickness throughout, top space 87 and bottom space 88.

As previously described with other embodiments of the present invention, the clearance space between the tank and the shell consisting of spaces 86, 87 and 88 may either be provided with fiberglass or urethane foam insulation or a combination in any of a number of well-known manners. However, the preferred embodiment for the present invention is to draw a vacuum in that clearance space thereby providing adequate thermal insulation without the need to add any fiberglass or urethane foam. Consequently, means are provided in the form of a small opening in either the top cover or the base or the surrounding side wall of the outer shell for attachment of evacuation device in order to pull the desired vacuum. Once the vacuum is pulled, the evacuation or suction device is removed and the opening appropriately sealed closed.

Also in accordance with the description of earlier embodiments regarding the present invention, it should be understood that a wide range of permutations are possible with regard to the construction techniques for the outer shell, tank and top cover. For example, supports 83 and 84 could be molded as part of the top wall 77 of the tank and fitted into top cover 82 by means of appropriately sized and positioned receiving channels. Similarly, supports 73 and 74 could be molded as part of the bottom surface 76 of the tank and aligned with receiving channels within bottom surface 72 of the shell 71. It is also envisioned that top cover 82 could include a generally concentric and cylindrical, downwardly opening receiving channel at its outer edge so as to receive the upwardly extending outer generally cylindrical edge of tank 71. It is also envisioned that in lieu of integrally molding the various members together as described that adhesively bonding these members together or spin-welding these members together would provide acceptable alternative techniques. The assembly of water heater 70 is completed by means of control portion 89 and heating element 90.

Figure 5:
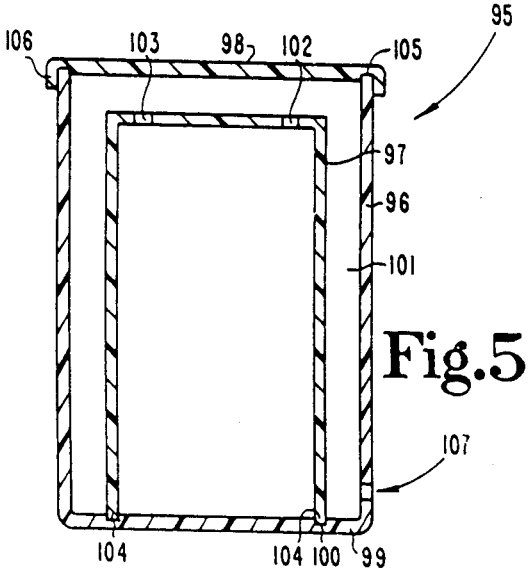
FIG. 5 is a front elevational view in full section of an alternative water heater construction according to a typical embodiment of the present invention.

Referring to FIG. 5, a still further alternative embodiment for the present invention is illustrated. In view of the prior disclosures for FIGS. 1–4. Not all of the specific details for the complete construction of a water heater will be illustrated, though the primary structural characteristics will be disclosed. For example, the control portion heating element are not illustrated in the FIG. 5 embodiment since this has been well documented in the description of the foregoing figures. Similarly, it should be understood that all of the previously described fabrication and assembly techniques will apply to this embodiment as well.

Water heater 95 includes a generally cylindrical outer shell 96, a generally cylindrical inner tank 97, and a top cover 98. Outer shell 96 is molded of a suitable plastic so as to include as a unitary homogeneous structure its generally cylindrical side wall as well as bottom wall 99 which has molded therein a generally cylindrical and concentric, upwardly opening receiving channel 100. Inner tank 97 is a unitary and homogeneous molded plastic member which is arranged generally concentric with shell 96 so as to define an annular space 101 therebetween. As with earlier embodiments, annular space 101 is of a substantially uniform radial thickness throughout its entirety. Tank 97 includes in its top surface openings 102 and 103 for the water inlet connection and the water outlet connection. An additional opening can be provided as necessary for pressure relief. The lower downwardly depending circumferential edge 104 of tank 97 fits snugly within receiving channel 100.

Top cover 98 which is molded as a unitary and homogeneous member includes a downwardly opening generally cylindrical and concentric channel 105 which is bounded on its outer periphery by downwardly depending outer lip 106. Receiving channel 105 is positioned and sized so as to snugly receive therein the upper cylindrical edge of shell 96. Opening 107 is provided in order to attach the necessary equipment to pull a vacuum on space 101 consistent with the teachings of the present invention and the descriptions of the foregoing embodiments.

Figure 6:
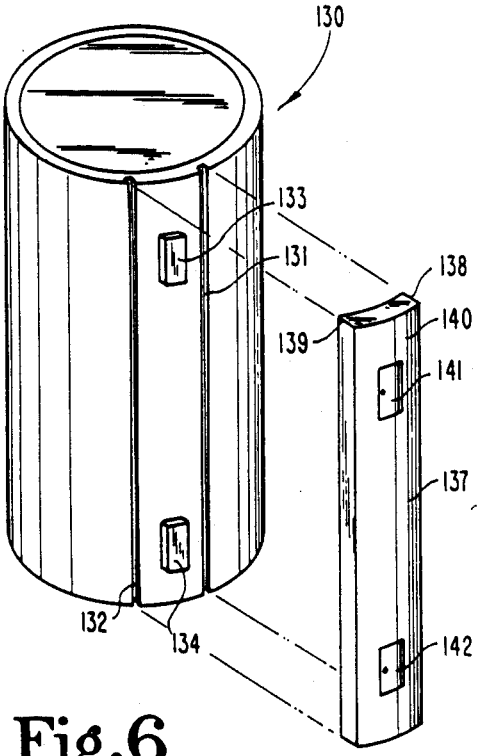
FIG. 6 is an exploded perspective view of a control panel and control panel cover comprising a portion of a plastic water heater construction according to the present invention.

Referring to FIG. 6, there is illustrated a plastic shell 130 for use with an electric water heater. The shell is of a generally cylindrical configuration and is open at least at one end. Consistent with the design of shells 22, 71 and 96, and consistent with the design of outer wall 48, shell 130 may be either molded as a single, integral member including an enclosing generally circular base panel or may be formed as an open cylinder and spin welded into a separate base panel. The top of shell 130 is to be closed in a manner consistent with the teachings of FIGS. 1, 2, 4 and 5.

What is illustrated in FIG. 6 is a construction of the outer plastic shell which enables electrical controls to be assembled and then covered in a protected aesthetically pleasing manner. The outer surface of shell 130 includes square cut channels 131 and 132 which extend only part way into the shell wall. These two channels are substantially parallel to each other and extend the full height of the shell. Control block 133 is representative of the assembly of the thermostat control for the corresponding water heater. Control block 134 is representative of the assembly of an electrical heating element which extends into the lower, center region of the corresponding water storage tank. It is to be understood that some clearance or access through the shell wall is provided for the controls associated with blocks 133 and 134.

Plastic cover 137 is generally U-shaped in lateral cross section including side ribs 138 and 139 and center panel 140. The side ribs are substantially parallel to each other and are spaced compatibly with the spacing of channels 131 and 132. The thickness of each rib 138 and 139 is just slightly less than the width of each channel 131 and 132 thereby enabling cover 137 to fit into the two channels and completely cover control blocks 133 and 134. Plastic cover 137 may either be formed with end panels, top and bottom to complete the enclosure, or the ends may be closed by the top cover of the overall heater assembly. A heat welding, frictional welding or alternatively an adhesive bonding technique is used to securely attach the cover 137 to the shell 130 via the referenced ribs and channels. If the cover is made of metal in lieu of plastic, threaded fasteners may be used to attach the cover to the shell. Cover 137 includes hinged doors 141 and 142 which are positioned in panel 140 so as to align directly over blocks 133 and 134, respectively, when the cover is attached to the shell. Opening of the doors thus provides access to the thermostat associated with block 133 and the heating element associated with block 134.

Figure 7:
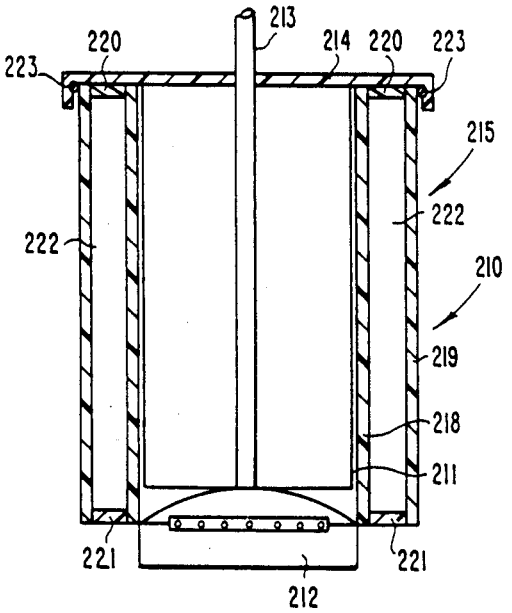
FIG. 7 is a front elevational view in full section of a gas water heater according to a typical embodiment of the present invention.

Referring to FIG. 7, there is illustrated a further embodiment of the present invention wherein water heater 210 includes a metal tank 211, a gas burner unit 212, a flue 213, a cover (top pan) 214, and an evacuated, double-walled plastic shell 215. As would be well known and performed according to typical construction methods, the gas burner unit 212 may be replaced with an electrical heating element and corresponding electrical controls. When an electrical heating element is used, appropriate access to the interior of the tank must be provided such as through the side walls of the tank an shell or through the bottom. Plastic externally threaded grommets are disposed around the electric heating element so as to align with internally threaded holes in the two side walls of shell 215.

Shell 215 which is fabricated off line and slides down over the tank includes concentrically disposed inner wall 218 and outer wall 219 and closing end walls 220 and 221 which have a substantially flat, annular ring configuration. Due to the straight and concentric nature of walls 218 and 219, end walls 220 and 221 are in alignment with each other. The generally cylindrical shape of shell 215 is actually tubular as is evacuated interior cavity 222. O-ring 223 completes the sealing of the cover 214 over the top of the tank and the shell. If a portion of the cover is configured so as to protrude down in to the top opening of the tank, much like a tight-fitting plug, then the O-ring 223 can be positioned as part of this protruding portion of the cover that fits snugly up against the inside surface of the tank.

Evacuation of cavity 222 can be accomplished while shell 215 is being fabricated or after completion by introducing an access hole into (through) outer wall 219, drawing a vacuum and then resealing the hole. Alternatively to evaucating or in addition to evacuating cavity 222, this volume may be filled with insulation, such as loose, discrete insulation or urethane foam insulation.

Figure 7A:
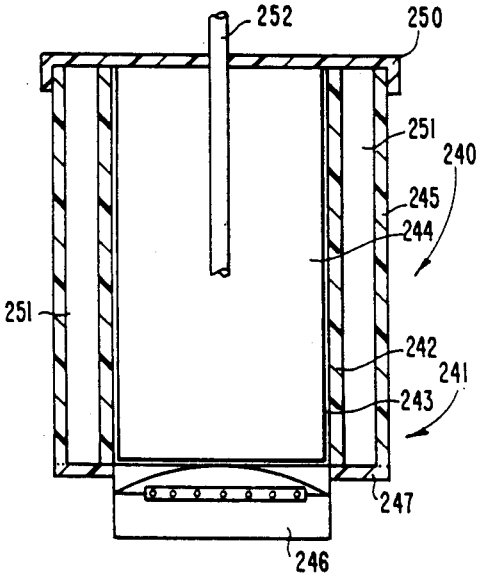
FIG. 7A is a front elevational view in full section of an alternative construction of the FIG. 7 water heater according to the present invention.

Referring to FIG. 7A, water heater 240 is illustrated and represents an alternative water heater construction to that of FIG. 7. In lieu of fabricating shell 241 off line as a separate item, plastic inner wall 242 is initially bonded to the outer surface 243 of tank 244. Next, plastic outer wall 245 is secured to the top of gas burner unit 246 and the tank is lowered into position. Lower radial lip 247 of the outer wall extends beneath inner wall 242 and the annular ring area of abutment is heat sealed thereto by welding two plastic surfaces together.

Plastic top cover 250 closes off the top of tank 244 and a tubular shell cavity 251 is created as a result of the substantially parallel concentric placement of outer wall 245 relative to inner wall 242. By heat sealing (plastic welding) the cover to the inner and outer walls, cavity 251 is sealed closed and thus may be evacuated. Evacuation can occur concurrently with the sealing of cover 250 or subsequently by introducing an access hole through either the cover or outer wall, drawing a vacuum on cavity 251 and thereafter sealing the access hole closed. In lieu of or in addition to evacuation of cavity 251, this volume may be filled with insulation.

Flue 252 is tightly sealed around its circumference at its point of exit through cover 250 in order to maintain the integrity of the pressurized condition on the interior of tank 244. It is also to be understood that in the FIG. 7A illustration as in most all illustrations herein, related features and components for a complete and fully operative water heater have been omitted solely for drawing clarity (less to show and fewer lines). It is to be understood that such features include tubular connections for water into the tank and water out from the tank, a pressure-relief valve, an electric heating element in an electric water heater is present in lieu of gas, a drain valve (faucet) and requisite thermostats and controls.

A further variation to the structure of FIG. 7A is to provide radial lip 247 as a separate piece, and incorporate grooves or channels (see FIG. 2) for the aligned receipt therein of both inner wall 242 and outer wall 245. Once positioned, the two walls are heat-sealed (plastic welding) to the lower radial lip in order to establish a secure, sealed and rigid assembly. The broken lines in FIG. 7A between lip 247 and the vertical wall portion of the outer wall 245 are representative of this design alternative.

Figure 8:
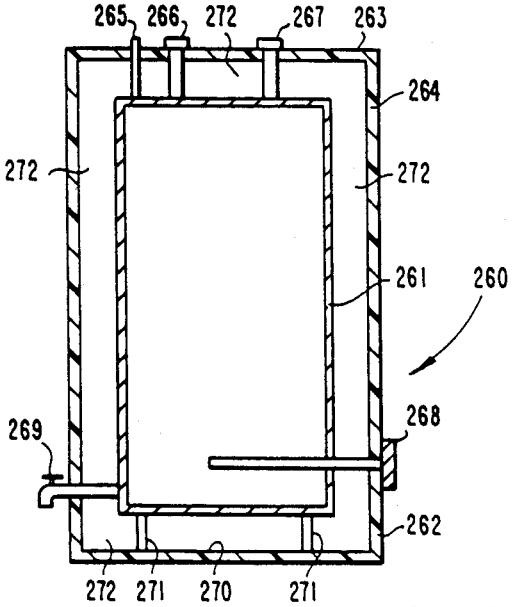
FIG. 8 is a front elevational view in full section of an alternative water heater design according to a typical embodiment of the present invention.

Referring to FIG. 8, there is illustrated another embodiment of the present invention. Water heater 260 includes a steel, inner water tank 261 which is generally cylindrical and concentrically enclosed by plastic outer shell 262. Plastic outer shell 262 includes a generally cylindrical cover 263 which is actually disc-like in appearance and spin-welded or alternatively adhesively welded or bonded to the upper edge of cylindrical side wall 264. Also illustrated is pressure-relief valve 265, water-in tube 266, water-out tube 267, electric heating unit 268 and drain tube (and faucet) 269.

Tank 261 is spaced from floor 270 by a plurality of support spacers 271 such that virtually the entirety of the tank (excepting out the various relief and flow fittings) is surrounded by an open space or cavity 272 which is defined by the outer surface of tank 261 and the inner surface of shell 262, including floor 270 and cover 263. Either as the cover is spin-welded in place or thereafter by introducing the needed access hole, a vacuum is pulled on cavity 272 so as to create a negative pressure throughout the cavity thereby enhancing the acoustical and thermal insulating properties for the tank. An earlier design for this clearance space was often filled with insulation such as fiberglass or urethane foam as examples. In the present invention, one embodiment insulates this space simply selecting an appropriate material for the shell such as a suitable plastic (either polyethylene or polystyrene) and by pulling a vacuum on cavity 272. This combination of vacuum and selected plastic material provides a low-cost and effective thermal and acoustical insulation.

Figure 9:
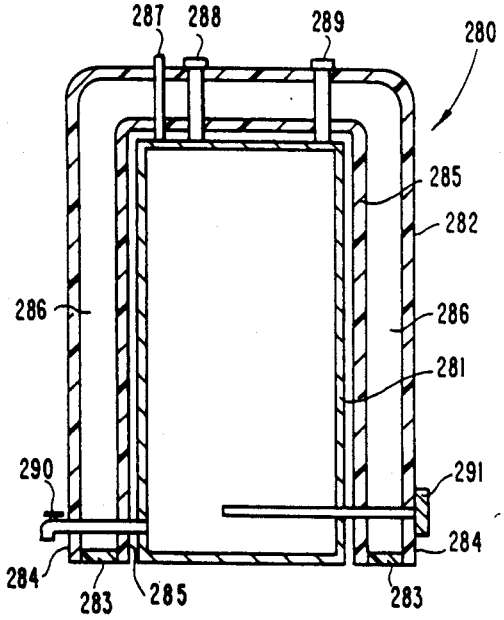
FIG. 9 is a front elevational view in full section of an alternative embodiment of a water heater construction according to the present invention.
Figure 10:
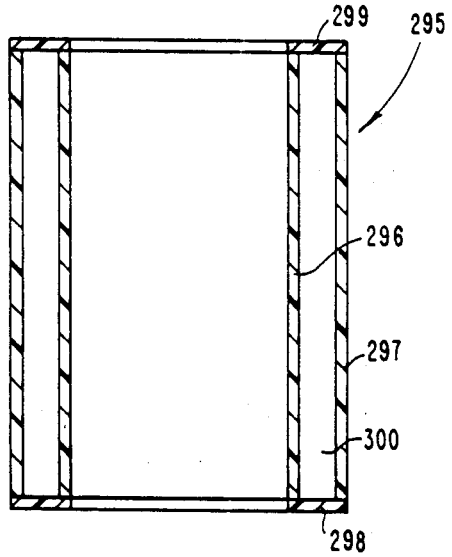
FIG. 10 is a front elevational view in full section of a plastic shell comprising a portion of the hot water heater construction of the present invention.

Referring to FIGS. 9 and 10, a still further embodiment of the present invention is illustrated. In FIG. 9, water heater 280 includes a generally cylindrical inner steel tank 281 surrounded by a plastic outer shell 282 of the double-walled construction. Each wall of shell 282 is molded as a unitary member incorporating therein a generally cylindrical body covered by a top panel and radiused corners connecting the top panel to the body. Closing base 283 is an annular ring shaped disc to which the lower edges of outer wall 284 and inner wall 285 are spin-welded or alternatively, adhesively welded or bonded so as to create therein an enclosed shell cavity 286. Access openings are provided through the shell (both walls) for relief valve 287, water inlet 288, water outlet 289, drain 290 and electric heating element 291.

Consistent with the teachings of the present invention, a vacuum is drawn on the inner cavity 286 of shell 282 after all the access openings receive their respective components and the interfaces are securely sealed. A vacuum may be drawn on cavity 286 by introducing an access opening through outer wall 284, pulling a vacuum and then sealing closed this opening.

As illustrated, the assembled shell 282 is sized and shaped so as to fit down over tank 281 without interference, though with a snug fit. In this regard, it is important that the shape of the inner surface of molded plastic inner wall 285 match quite closely the geometry of the outer surface of tank 281. The shape of the outer wall 284 is less critical, though aesthetically and for uniformity in the lateral width of cavity 286, the inner and outer walls of shell 282 should be virtually identical in shape and different in size. The size difference directly relates to the lateral (radial) width size of the cavity.

With reference to FIG. 10, an alternative to the double-walled, molded plastic construction of shell 282 is illustrated. Shell 295 begins with a double-walled, generally cylindrical member which includes a generally cylindrical plastic inner wall 296, a generally cylindrical, plastic outer wall 297, an enclosing base panel 298 and an enclosing top panel 299. Both panel 298 and panel 299 have an annular ring-like, disc shape such that shell 295 is tubular and open in the center at both top and bottom ends. By arranging the inner and outer plastic walls generally concentric to each other, the lateral (radial) width of annular clearance space 300 is substantially uniform throughout its circumference and throughout its height.

In view of the ability to easily fabricate, mold, shape and join plastic, a number of construction variations are envisioned in order to fabricate the enclosed, double-walled, tubular configuration of shells 282 and 295. On option is to mold the inner and outer walls as flat sheets, form them into cylindrical shapes and weld the seam closed. The top and bottom panels (annular rings or discs) are also molded and the ends of the two walls are spin-welded (or adhesively joined) to the top and bottom panels in order to create the illustrated shell.

Figure 10C:
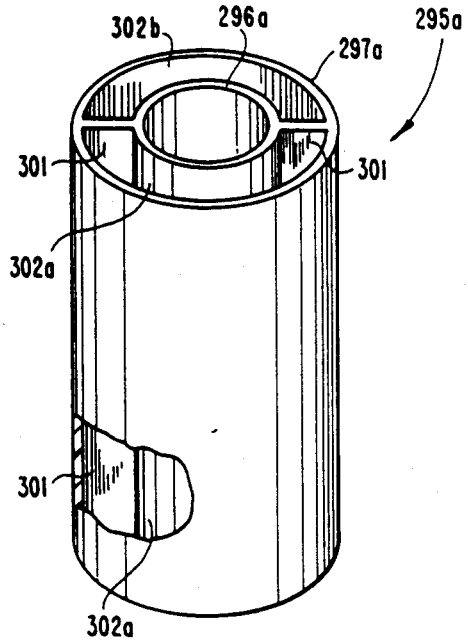
FIG. 10C is an alternative fabrication technique for the FIG. 10 shell.
Figure 10A:
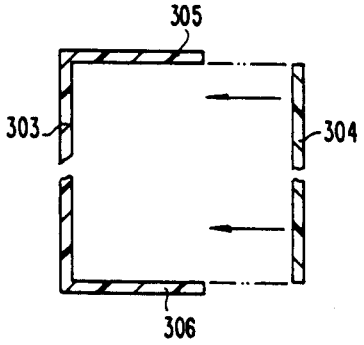
FIG. 10A is a detail of one fabrication technique for the FIG. 10 shell.
Figure 11:
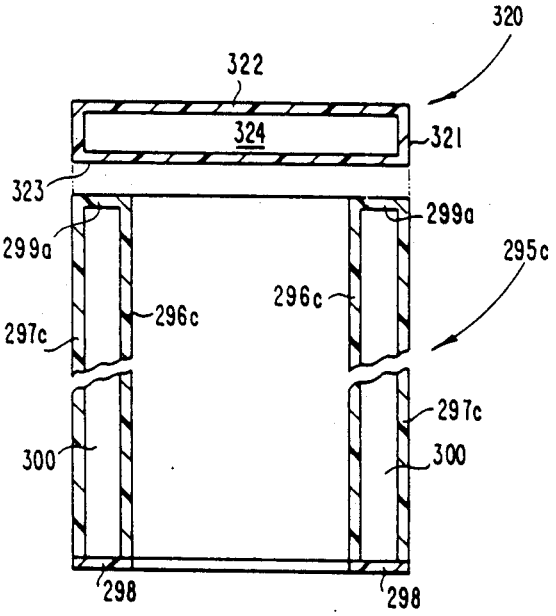
FIG. 11 is a partial, front elevational view in full section of a plastic cover for a double-walled plastic water heater shell according to the present invention.

Another option is to mold or cast the two walls and either the top end panel or the bottom end panel as a single, integral member (see FIG. 11). The opposite end panel (disc) which is not integrally molded with the walls is separately fabricated and then placed over the open end of the cavity 286 (or clearance space 300) and the abutting edges are spin-welded in order to complete the shell. A still further fabrication option is illustrated in FIG. 10A wherein the outer wall 303 or alternatively the inner wall 304 is molded with one or both ends 305, 306 and the other wall is separately molded. The assembly technique is to spin weld or adhesively joined the separate wall 304 to the ends 305 and 306 (see FIG. 10A).

Figure 10B:
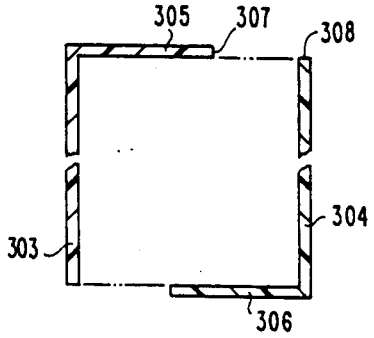
FIG. 10B is an alternative fabrication technique for the FIG. 10 shell.

The approach of FIG. 10A is modified slightly in the arrangement of FIG. 10B wherein one wall 303 is molded as a single, integral member with one end 305 and the same fabrication technique is followed for the other wall 304 and the other end 306. The final assembly is achieved by spin-welding or otherwise joining the inner circular edge 307 of end 305 to the upper circular edge 308 of wall 304 and similarly end 306 to wall 303. In both the FIG. 10A and FIG. 10B illustrations, the partial drawings are of only one side of the tubular shell. It is to be understood that walls 303 and 304 are cylindrical and ends 305 and 306 are annular ring-like, discs in shape, substantially flat and parallel to each other.

Referring to FIG. 10C, there is illustrated a still further embodiment of the construction of a plastic shell similar to shell 295 as illustrated in FIG. 10. Shell 295*a* includes a generally cylindrical inner wall 296*a* and a generally cylindrical outer wall 297*a* which are concentric to each other and connected internally by oppositely disposed ribs 301. It is intended to be illustrated that shell 295*a* is molded as a single, integral plastic member wherein the tubular-shaped clearance space between the inner and outer walls is divided by axially extending ribs 301 into two halves 302*a* and 302*b*.

Shell 295*a* may be molded with either one end open or both ends open but ultimately the two halves 302*a* and 302*b* of the clearance space are enclosed and sealed on both ends and a vacuum pulled on the enclosed cavity existing in each half. The construction as well as the method of sealing closed the various cavities and drawing a vacuum on those cavities will be performed similar to what has already been described with regard to FIG. 10 and shell 295. Alternatively, the two cavities can also be filled with insulation material, such as loose, discrete insulation material with or without a vacuum being drawn.

Figure 10D:
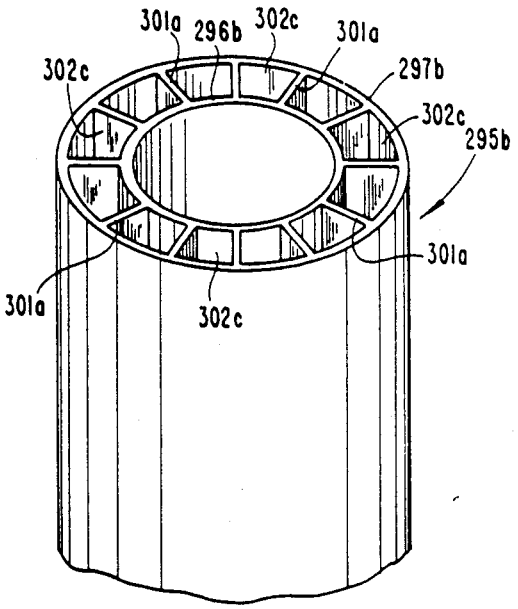
FIG. 10D is an alternative fabrication technique for the FIG. 10 shell.

Referring to FIG. 10D, there is illustrated a still further embodiment for the construction of a plastic shell similar to shells 295 and 295*a* as illustrated in FIGS. 10 and 10C, respectively. Shell 295*b* includes a generally cylindrical inner wall 296*b* and a generally cylindrical outer wall 297*b*. The inner and outer walls are concentric to each other and are connected internally by 12 axially and radially extending ribs 301*a*. It is intended to be illustrated that shell 295*b* is molded as a single, integral plastic member wherein the annular clearance space is partitioned by ribs 301*a* into 12 virtually identical wedge-shaped compartments 302*c*.

Shell 295*b* may be molded with either one end open or both ends open, but ultimately both ends are closed and sealed so that a vacuum may be drawn on each enclosed compartment 302*c* individually, in a manner similar to what has already been described with regard to shell 295 in FIG. 10 and shell 295*a* in FIG. 10C. While the 12 compartments may be filled with insulation material either with or without a vacuum being drawn, one advantage of shell 295*b* lies in the fact that each compartment 302*c* is individually enclosed and sealed. If there is any break in any seam or any type of puncture or perforation which would release the vacuum, then it only affects one of the 12 compartments and not the entire clearance space.

In the FIG. 9 embodiment which is of course also true for FIG. 10, the tank 281 which is disposed within shell 282 or shell 295 may be constructed of steel or some other metal, such as deep drawn aluminum. It is also to be understood that in each of the FIGS. 8, 9 and 10 embodiments the evacuated cavity may alternatively be filled with insulation, such as loose, discrete insulation or urethane foam insulation. Even if insulation is added into these various cavities (clearance spaces), a vacuum can still be drawn in the same manner as previously described, using an access hole through the outer wall of the shell (or inner wall if done before assembly over the tank).

Referring again, though briefly to FIG. 8, water heater 260 is an electric water heater with the necessary openings through the shell side walls 264 and cover 263 for the requisite pipes, fittings, and heating element to be assembled. When a gas water heater is present, a clearance space out the top or at some location must be provided. Similarly, if water heater 280 (FIG. 9) is gas instead of electric, exit access for the flue must be provided.

With regard to the construction of shell 295 (FIG. 10), it is possible to structure the cover as a double-walled lid 320 as illustrated in FIG. 11. Also illustrated in FIG. 11 is the option of integrally molding one end panel (disc), in this case the top disc 299*a*, as part of the concentric inner and outer walls while the oppsite disc is a separate piece. As previously described, shell 295*c* which includes inner cylindrical wall 296*c* and outer cylindrical wall 297*c* is designed to slide down over the generally cylindrical water storage tank and is designed to have its top open area covered in an appropriate manner in order to complete the assembly of the water heater. Apart from the construction options and variations for the plastic shell, many of which have already been described and illustrated, some type of cover is important in order to keep heat loss from the top of the tank to a minimum. The molded "hood" design of FIG. 9 incorporates the cover as part of the molded design of the double-walled shell. However, in the FIG. 10 configuration, the open center region of the shell, the region which receives the tank, is not covered and thus a separate member is employed for enclosing the top of the shell, in this example the separate member is lid 320.

Lid 320 is a hollow, enclosed, generally cylindrical plastic member having a cylindrical side wall 321, top disc 322 and bottom disc 323 which are joined to the upper and lower circular edges of wall 321 by spin-welding or similar construction techniques. A variety of arrangements are possible for molding portions of lid 320 as integral units, such as molding bottom disc 323 and side wall 321 as a single unit and then spin-welding top disc 322 in place. It is also possible to blow mold the entirety of lid 320 as a single, integral piece. The two discs and side walls define interior cavity 324 which may be either evacuated as previously described for the double-walled shells or this volume may be filled with loose, discrete insulation or urethane foam insulation. After lid 320 is fabricated, it is secured to the top of shell 295 by a suitable assembly technique such as by spin-welding or by adhesively bonding.

Figure 12:
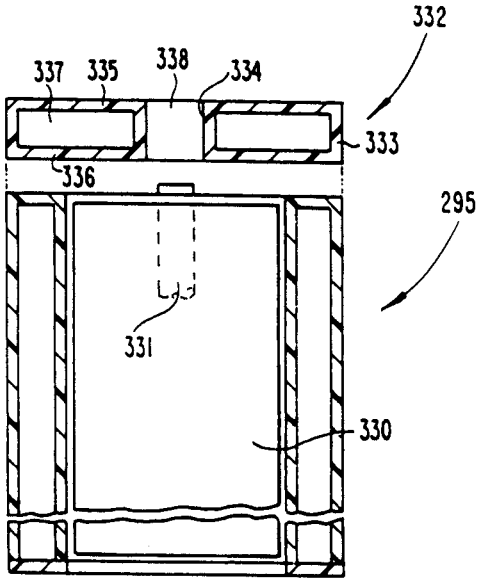
FIG. 12 is a partial, front elevational view in full section of an alternative top construction to the construction of FIG. 11.

When the construction style lid 320 is used for a gas water heater, some attention must be directed to a clearance space for the exiting of the flue which allows the combustion by-products (gases) to be vented to the atmosphere. In order to maintain the lid style which includes an interior cavity, the lid construction of FIG. 12 has been conceived. Referring to FIG. 12, plastic shell 295 is disposed around water storage tank 330 which is part of a gas water heater which includes a flue 331 extending upwardly through the top of the tank. The lid 332 is generally cylindrical with an annular ring-like shape including cylindrical outside wall 333, cylindrical inside wall 334 which is concentric to wall 333, top annular ring disc 335 and bottom annular ring disc 336 which is substantially parallel to the top disc. The joined and sealed combination of walls and discs defines an enclosed cavity 337 to which a vacuum is drawn, or alternatively which is filled with insulation either loose, discrete insulation or urethane foam insulation.

Center clearance opening 338 is generally cylindrical and provides adequate clearance for flue 331. Alignment is controlled by the position of the opening 338 relative to outside wall 333 which is generally concentric with the outside wall of shell 295 when lid 332 is secured onto the top of shell 295.

Figure 13:
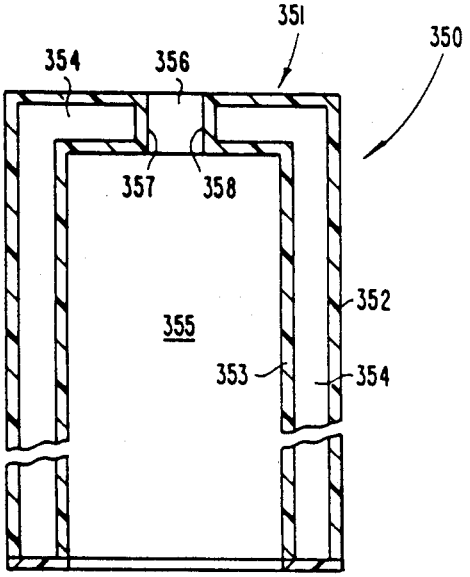
FIG. 13 is a partial, front elevational view in full section of a water heater shell configured as a plastic double-walled design according to the present invention.

Referring to FIG. 13, plastic shell 350 is illustrated as a double-walled shell wherein the top or cover portion 351 is formed (molded) or welded to the generally cylindrical side walls 352 and 353 such that the enclosed interior cavity 354 extends cylindrically around and radially over space 355. In this configuration, the interior cavities of the cylindrical shell body and top lid portion are in open communication giving shell 350 the appearance of an integral, unitary molded member. In reality certain wall portions of shell 350 may have to be separately fabricated and then joined to the remainder by either spin-welding, or adhesively bonding or by a similar joining technique which is suitable for plastic. However, it may be possible to blow mold the entirety of shell 350 as a single piece. Clearance space 356 is defined by vertical wall portions 357 and 358 and provides the requisite clearance space or opening for the flue 331 (see FIG. 12).

Figure 14:
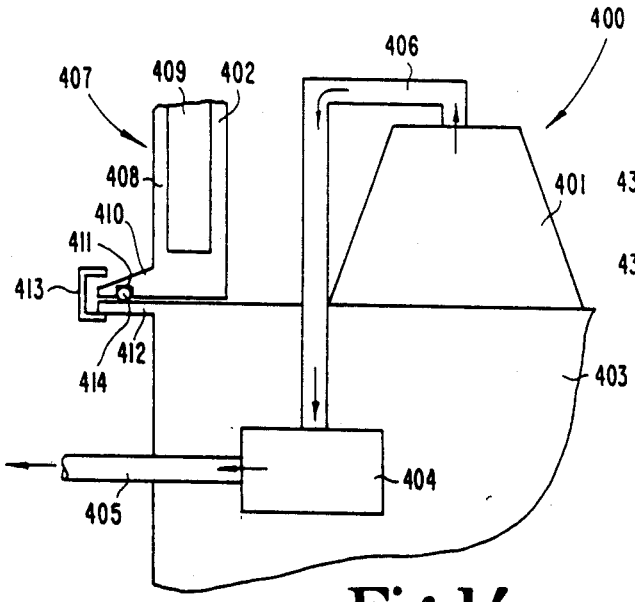
FIG. 14 is a partial, diagrammatic illustration of a gas water heater showing the flue gas exit and the construction of the corresponding shell and tank.

Referring to FIG. 14, there is illustrated in partial form gas water heater 400 which includes a gas burner unit 401 disposed within the lower region of a water storage tank. A partial wall 402 of the storage tank is illustrated and sets upon base 403 as does gas burner unit 401. Base 403 houses the blower 404 which has an outlet (exhaust) pipe 405 connected to the output side of the blower and is designed to exhaust flue gases to the atmosphere outside of the house or building. The inlet pipe 406 connects the burner unit 401 to the blower 404 and flue gases from the burner unit are drawn into the blower via pipe 406 and discharged via pipe 405, as shown by the directional flow arrows The storage tank and outer shell combination 407 include inner wall 402 and outer wall 408, both of which are plastic. In accordance with the teachings of FIGS. 1, 2, 4, 5 and 8 as to appropriate construction techniques for a double-walled plastic tank and shell, walls 402 and 408 are completely sealed and securely joined so as to define an interior cavity 409 which is evacuated or alternatively filled with insulation material. Although not illustrated, the top or cover may be configured in a variety of ways as previously illustrated and described, though in the FIG. 14 arrangement, the walls are configured similarly to the double-walled shell in FIG. 9. In the FIG. 14 arrangement, there is not a separate tank as in FIG. 9, but the way the top of the shell is molded as part of a cylindrical side walls for the shell of FIG. 9 is followed for the shell and tank combination of FIG. 14.

The lower portion of outer wall 408 includes a radially extending (outwardly) tapered lip 410 which includes O-ring groove 411. The upper edge of base 403 includes a substantially flat outwardly radiating flange 412 which is clamped in abutment with lip 410 by the generally circular two-part clamp 413 (see FIG. 15) which has two semi-circular (semi-cylindrical) halves and outwardly radiating flanges which may be tightened together in order to securely clamp the shell and tank combination to the base in a fluid-tight fashion. The underside or bottom surface of walls 402 and 408 are flush and in abutment against the top surface of base 403 and in addition to the securement and seal provided by clamp 413, adhesive is used to securely attach the shell and tank combination to the base. The base thus serves as the final component to complete the enclosing of the tank. The O-ring 414 placed in groove 411 is sized such that it is compressed as clamp 413 is tightened. The tapering nature of lip 410 creates a vertical tightening force in response to circumferential tightening of clamp 413.

Figure 15:
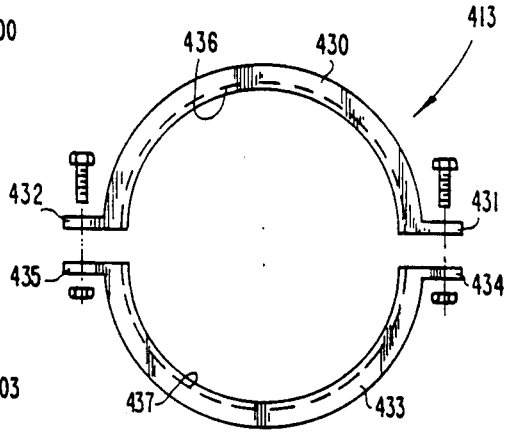
FIG. 15 is an exploded top plan view of a clamping ring comprising a portion of the FIG. 14 gas water heater.

Referring briefly to FIG. 15, clamp 413 includes first halve 430 which as described is semi-cylindrical and disposed at its opposite free ends are abutment flanges 431 and 432. Similarly, the second clamp half 433 is also semi-cylindrical and similarly configured with outwardly radiating abutment flanges for 434 and 435. As is illustrated in FIG. 14, both first half 430 and second half 433 has a generally square-cut blind channel 436 and 437, respectively which receives the abutting and outward edges of tapered lip 410 and flat flange 412. The abutting flanges 431 to 434 and 432 to 435 include clearance holes for receipt of fasteners as illustrated in exploded view form. As the fasteners are tightened in place, the flanges are drawn together and there is a radial tightening by means of clamp 413 around the perimeter of the water heater. As indicated, this radial tightening pulls the channels inwardly and as the edges of the clamp ride up on the tapering incline of lip 410, a compressive force is created which is directed downwardly so as to create the tight and secure sealing of the tank and shell wall to the base.

Figure 16:
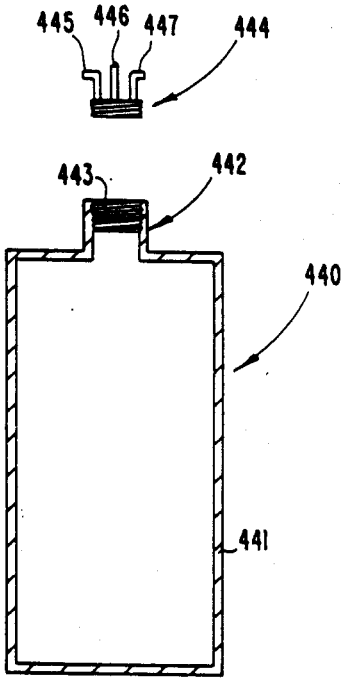
FIG. 16 is a front elevational view in full section of a steel tank design suitable for use with a plastic shell for the construction of a water heater according to the present invention.

Referring to FIG. 16, there is illustrated a generally cylindrical steel tank 440 which includes a main body 441, a centrally disposed and upwardly extending neck portion 442 which includes as part thereof an internally threaded outlet 443. Illustrated in exploded view form is a complementing and closing plug 444 which is externally threaded and includes a series of flow pipes or tubes 445, 446 and 447 which represent a water inlet tube, a water outlet tube or pipe and the pressure-relief valve. It is to be understood that a variety of construction variations are envisioned for this particular tank which is intended to represent one of several suitable water storage tanks for use in combination with surrounding shells and enclosures for the creation of a residential or commercial hot water heater. Plug 444 is designed to permit a quick and simple assembly of the requisite parts and fittings to the tank thereby enabling the tank to be separately fabricated off line as well as the plug and then joined together. So long as the thread size of outlet 443 and the thread size of plug 444 are kept compatible, great construction versatility is offered.

Figure 17:
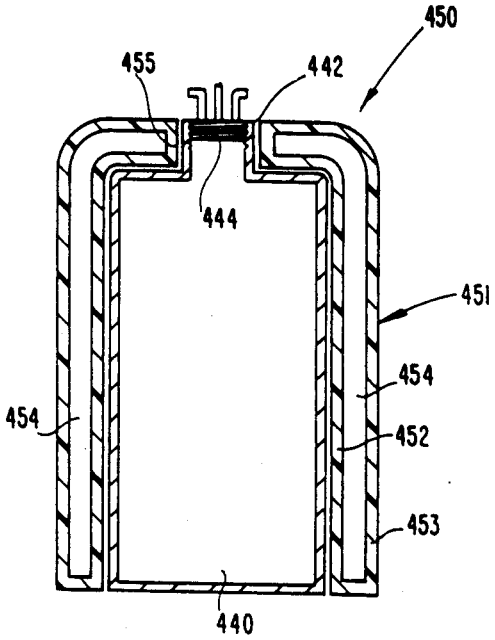
FIG. 17 is a front elevational view of the FIG. 16 tank as installed within a double-walled plastic shell.

Referring to FIG. 17 a water heater assembly 450 is illustrated as including tank 440, with plug 444 threadedly received in the neck outlet and surrounded by a double-walled plastic shell 451 which has been molded in part such that the inner wall 452 closely conforms to the size, shape and geometry of tank 440 so as to fit closely and snugly therearound. Outer wall 453 is similarly shaped though of somewhat larger size so as to define an interior cavity 454 which in the illustrated embodiment is evacuated. It is to be understood that shell 451 can be fabricated by virtually any of the foregoing illustrated and described techniques herein, including blow molding the entire shell 451. The important aspects to learn from the FIG. 17 illustration is that the inner wall 452 is molded so as to match very closely the shape of tank 440, whatever that shape may be in any particular embodiment. It is also to be noted that shell 451 has the top portion or cover molded as part of the surrounding generally cylindrical side walls and this top cover or end cover defines a generally cylindrical clearance opening 455 through which the neck 442 of the steel tank extends. It is appropriate to closely size the diameter of opening 455 so as to have a snug fit with the outer surface of neck 442 so that a rigid and tight seal can be easily established.

Figure 18:
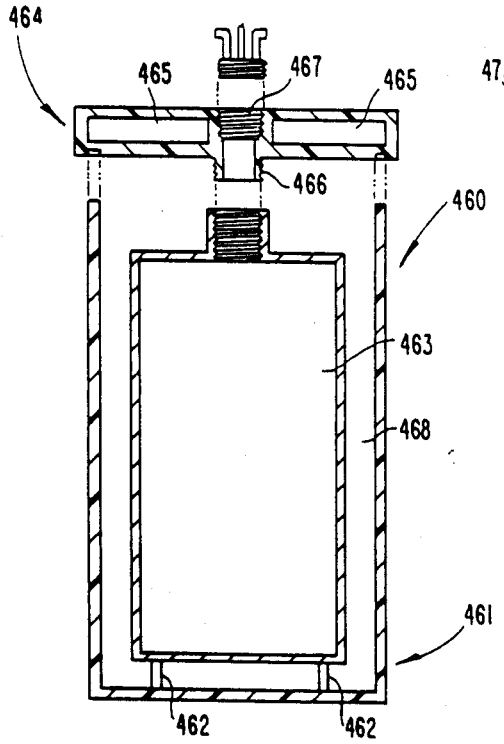
FIG. 18 is an exploded, front elevational view in full section of a steel tank disposed within a plastic shell having a double-walled plastic top according to the present invention.

Referring to FIG. 18, water heater 460 is illustrated with a construction approach which is similar in some respects to that of FIG. 1, at least as to the design of the plastic shell 461 and the supports 462 for the inner tank. In this particular arrangement, the inner tank 463 is a steel tank consistent with the size, shape and design of tank 440. The primary feature to be conveyed by FIG. 18 is the design of the top cover 464 which is designed as a double-walled member completely sealed so as to establish an interior cavity 465 which is of an annular ring shape and which has an externally threaded lower plug portion 466 and an internally threaded upper opening 467 in alignment therewith which is sized and arranged in a style virtually identical to plug 444. This particular arrangement allows the cover 464 to be adhesively bonded or spin-welded to the upper peripheral edge of shell 461 and this bonding occurs in a circular fashion as the externally threaded plug is inserted into the internally threaded neck outlet of the tank. Once this assembly is completed, a sealed cavity 468 is defined between the outer wall of the tank and the inner wall of the plastic shell and this cavity may then be evacuated in accordance with the present invention. Plastic cap 469 fits into opening 467 and provides openings for the various plumbing fittings.

Figure 19:
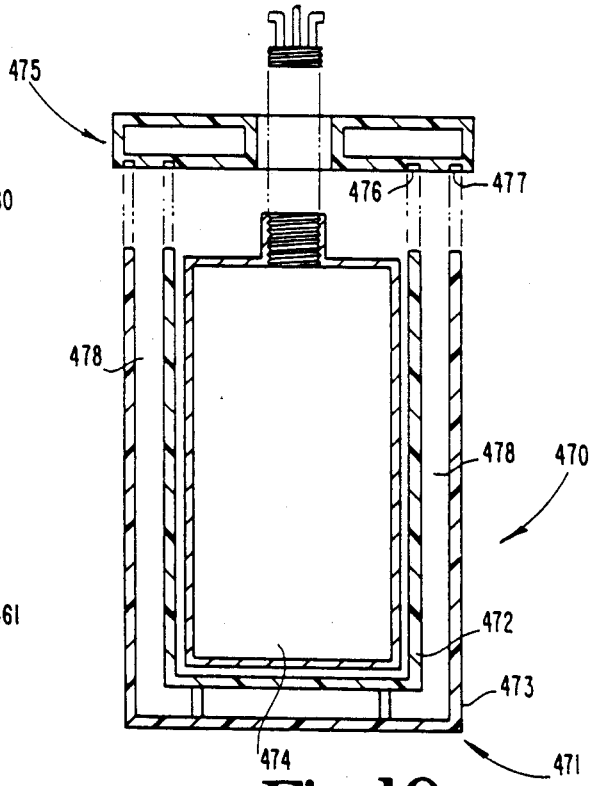
FIG. 19 is an exploded, front elevational view in full section of a steel tank disposed within a double-walled plastic shell and including a double-walled plastic top according to the present invention.

Referring to FIG. 19, a slight variation to the construction of water heater 460 is illustated. Water heater 470 is virtually identical to all of the foregoing descriptions for water heater 460 in FIG. 18 with the one exception that the plastic shell 471 in FIG. 19 is of a double-walled construction including inner plastic wall 472 and outer plastic wall 473 which are similarly shaped to each other and to the contour of steel tank 474 such that when cover 475 is rotated into position and the upper edges of walls 472 and 473 are received within radial channels 476 and 477, respectively, and enclosed cavity 478 is defined and is evacuated in accordance with the teachings of the present invention.

Figure 20:
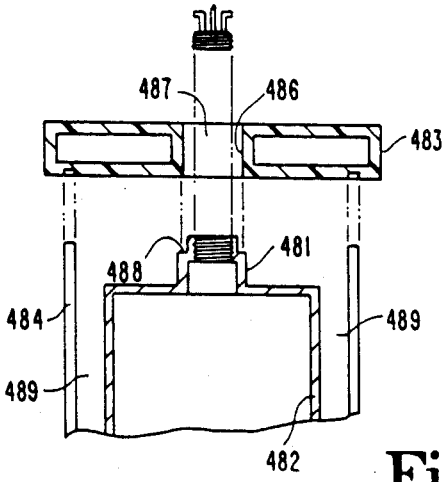
FIG. 20 is a front elevational view in full section of an alternative tank, shell and top construction according to the present invention.
Figure 21:
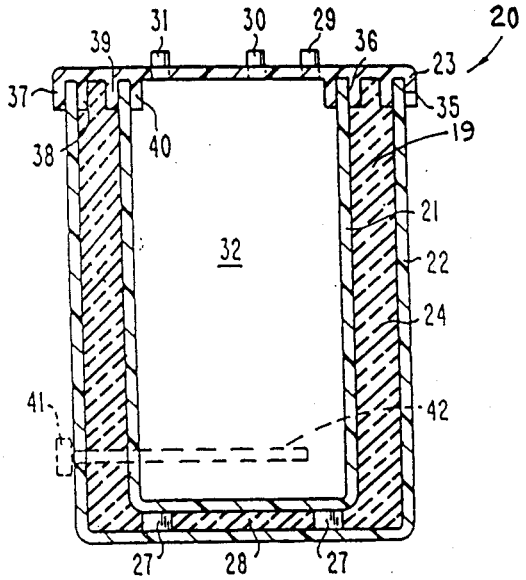
FIG. 21 is a front elevational view in full section of a hot water heater constructed of plastic according to a typical embodiment of the present invention.
Figure 22:
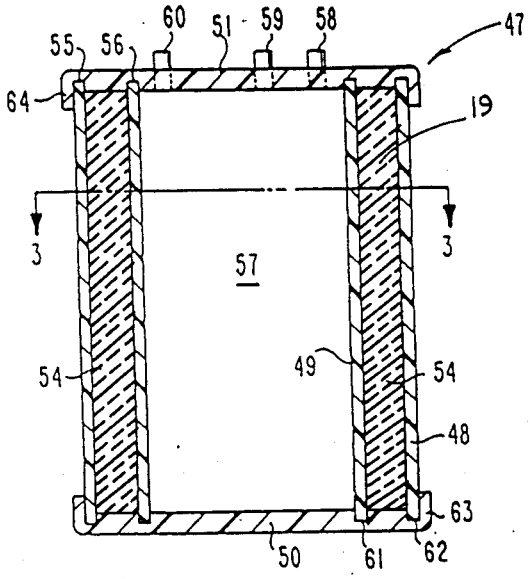
FIG. 22 is a front elevational view in full section of an alternative plastic water heater according to a typical embodiment of the present invention.
Figure 23:
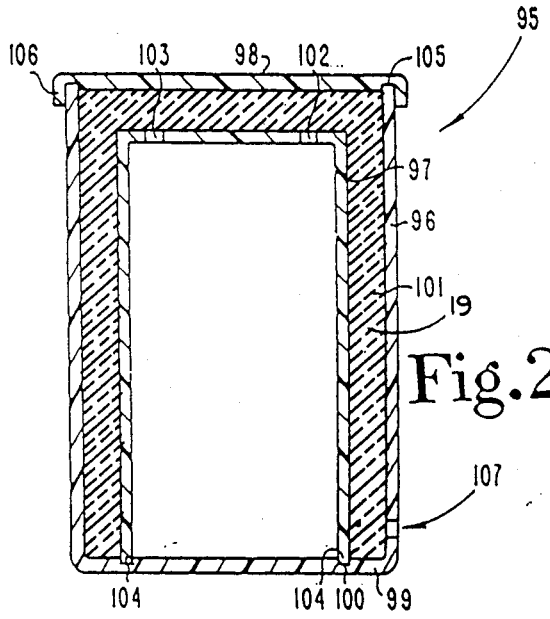
FIG. 23 is a front elevational view in full section of an alternative water heater construction according to a typical embodiment of the present invention.
Figure 24:
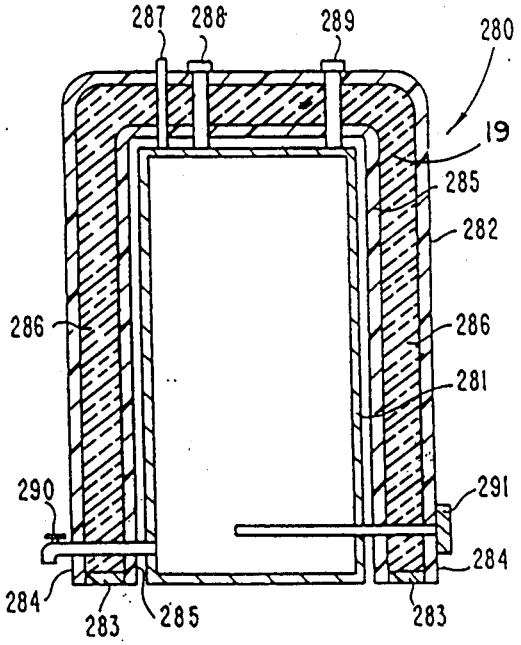
FIG. 24 is a front elevational view in full section of an alternative embodiment of a water heater construction according to the present invention.
Figure 25:
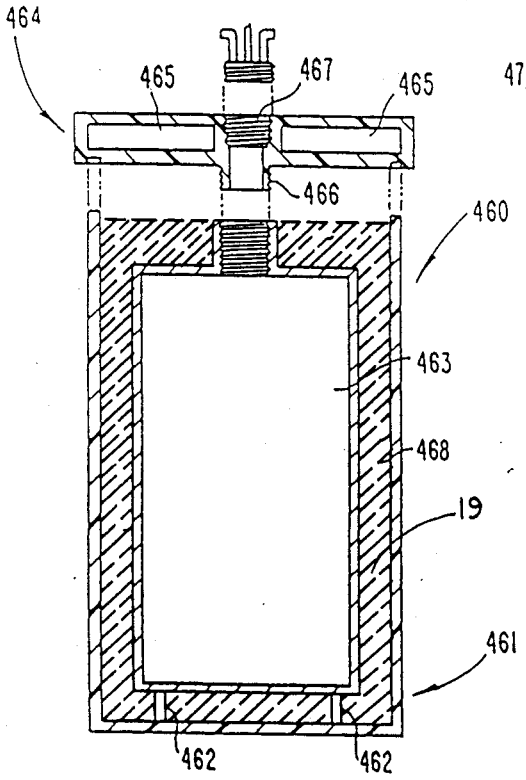
FIG. 25 is an exploded, front elevational view in full section of a steel tank disposed within a plastic shell having a double-walled plastic top according to the present invention.
Figure 26:
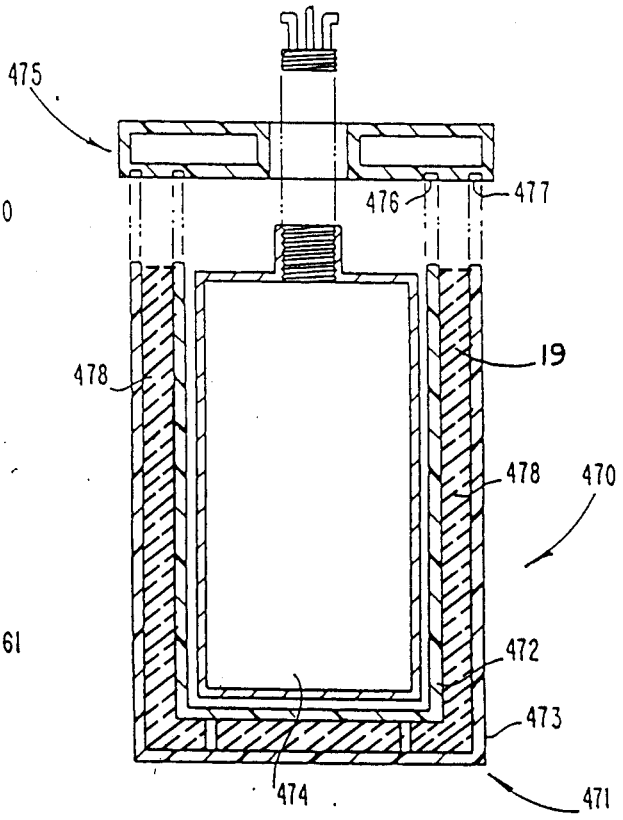
FIG. 26 is an exploded, front elevational view in full section of a steel tank disposed within a double-walled plastic shell and including a double-walled plastic top according to the present invention.

Referring to FIG. 20, a further variation to the designs of FIGS. 18 and 19 is illustrated wherein the neck 481 of tank 482 is shouldered such that as cover 483 is assembled to the wall of the outer plastic shell 484, the inside generally circular edge or corner 486 of clearance opening 487 is drawn into tight and abutting engagement against the shouldered portion 488 of neck 481 thereby establishing a fluid-tight seal at that point and thus enabling a vacuum to be pulled on the created cavity 489 existing between the plastic shell, the inner tank and the cover. The inner tank 482 can be made of plastic thereby allowing for the actual welding of the shouldered portion 488 to the lower inside circular edge of cover 483.

By injecting urethane foam (in liquid state) for the foam insulation requirements, and then pulling a partial vacuum while the foam is rising (foaming) the cell size can be increased. This technique allows for a very low density foam, a lower cost product and less fluorocarbon use. All of the foregoing embodiments described and illustrated can use this technique. This technique is not possible with current metal construction due to the nonsealed nature of sheet metal construction.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A water heater comprising:

a generally cylindrical, molded plastic inner water tank;

a generally cylindrical, molded plastic outer shell disposed circumferentially around and spaced outwardly from said inner water tank and defining with said inner water tank an annular clearance space between the outer surface of said inner water tank and the inner surface of said outer shell; and enclosing means cooperatively arranged with said outer shell and with said inner water tank so as to seal closed said annular clearance space, said annular clearance space having insulation material disposed therein and said annular clearance space maintained at a negative pressure.

2. The water heater of claim 1 wherein said outer shell includes a lower edge and an upper open end and said enclosing means includes a base panel integral with the lower edge of said outer shell and a top cover disposed over the upper open end of said outer shell.

3. The water heater of claim 2 which further includes tank supports disposed between said base panel and said inner water tank such that said base panel is spaced apart from said inner water tank.

4. The water heater of claim 1 wherein said outer shell includes a generally cylindrical body and molded integrally therewith as a single unit a generally circular base panel.

5. A water heater comprising:

a generally cylindrical inner water tank having a top surface;

an enclosed, molded plastic outer shell disposed around and spaced apart from said inner water tank, said outer shell including:

a generally cylindrical body portion having a generally circular upper edge and coaxial therewith a generally circular lower edge;

a lower enclosing panel forming the bottom surface of said inner water tank and joined to the lower edge of said body portion; and an upper enclosing panel disposed over the top surface of said inner water tank and joined to the upper edge of said body portion; and said outer shell and said inner water tank cooperatively arranged to define a sealed clearance space therebetween, said clearance space maintained at a negative pressure.

6. The water heater of claim 5 which further includes a plurality of supports disposed between the inside surface of said outer shell and the outside surface of said inner water tank.

7. The water heater of claim 5 wherein said upper enclosing panel is a molded plastic, hollow cover.

8. A water heater comprising:

a generally cylindrical, molded plastic inner water tank;

a generally cylindrical, molded plastic outer shell disposed circumferentially around and spaced outwardly from said inner water tank and defining with said inner water tank an annular clearance space between the outer surface of said inner water tank and the inner surface of said outer shell;

enclosing means cooperatively arranged with said outer shell and with said inner water tank so as to seal closed said annular clearance space, said annular clearance space having insulation material disposed therein and said clearance space maintained at a negative pressure;

said outer shell including a lower edge and an upper open end and said enclosing means including a base panel integral with the lower edge of said outer shell and a top cover disposed over the upper open end of said outer shell; and said inner water tank including a generally cylindrical body which is open at its upper end and wherein said top cover includes a generally cylindrical receiving channel which is sized and arranged to receive the upper end of said inner water tank.

9. A water heater comprising:

a generally cylindrical, molded plastic inner water tank;

a generally cylindrical, molded plastic outer shell disposed circumferentially around and spaced outwardly from said inner water tank and defining with said inner water tank an annular clearance space between the outer surface of said inner water tank and the inner surface of said outer shell;

enclosing means cooperatively arranged with said outer shell and with said inner water tank so as to seal closed said annular clearance space, said annular clearance space having insulation material disposed therein and said clearance space maintained at a negative pressure;

said outer shell including a generally cylindrical body and molded integrally therewith as a single unit a generally circular base panel; and said inner water tank being open at its upper end and said outer shell being open at its upper end and wherein said enclosing means further includes a top cover arranged with inner and outer, generally concentric, generally cylindrical receiving channels, said outer channel sized and arranged to receive the upper end of said outer shell and said inner channel sized and arranged to receive the upper end of said inner water tank.

10. A water heater comprising:

a generally cylindrical, molded plastic inner water tank;

a generally cylindrical, molded plastic outer shell disposed circumferentially around and spaced outwardly from said inner water tank and defining with said inner water tank an annular clearance space between the outer surface of said inner water tank and the inner surface of said outer shell;

enclosing means cooperatively arranged with said outer shell and with said inner water tank so as to seal closed said annular clearance space, said annular clearance space having insulation material disposed therein and said clearance space maintained at a negative pressure; and said inner water tank including a generally cylindrical body which is open at its lower end and wherein said enclosing means includes a base panel formed with a generally cylindrical receiving channel sized and arranged to receive the lower end of said inner water tank.

11. A water heater comprising:

a generally cylindrical, molded plastic inner water tank;

a generally cylindrical, molded plastic outer shell disposed circumferentially around and spaced outwardly from said inner water tank and defining with said inner water tank an annular clearance space between the outer surface of said inner water tank and the inner surface of said outer shell;

enclosing means cooperatively arranged with said outer shell and with said inner water tank so as to seal closed said annular clearance space, said annular clearance space having insulation material disposed therein and said clearance space maintained at a negative pressure; and said inner water tank being open at its upper end and said outer shell being open at its upper end and wherein said enclosing means further includes a top cover arranged with inner and outer, generally concentric, generally cylindrical receiving channels, said outer channel sized and arranged to receive the upper end of said outer shell and said inner channel sized and arranged to receive the upper end of said inner water tank.

12. A water heater comprising:

a generally cylindrical inner water tank; and a generally cylindrical, molded plastic outer shell disposed circumferentially around said inner water tank, said outer shell including:

a spaced-apart pair of generally concentric, generally cylindrical walls defining an annular space therebetween; and enclosing means disposed at each end as part of said outer shell and cooperatively arranged with said pair of generally cylindrical walls so as to seal closed said annular space, said annular space having insulation material disposed therein and said annular space maintained at a negative pressure.

13. A water heater comprising:

generally cylindrical inner water tank; and a double-walled, molded plastic outer shell disposed around said inner water tank, said outer shell including:

an inner U-shaped wall;

an outer U-shaped wall which is shaped similarly to said inner U-shaped wall and which is spaced apart and outwardly of said inner U-shaped wall so as to define therewith a clearance space therebetween; and enclosing means disposed at the free ends of said U-shaped walls and cooperatively arranged therewith so as to seal closed said clearance space, said clearance space having insulation material disposed therein and said clearance space maintained at a negative pressure.

14. A method of constructing a water heater comprising the following steps:

providing a generally cylindrical inner water tank;

molding a generally cylindrical double-walled plastic outer shell with a sealed-closed interior cavity between said walls;

placing said inner water tank within said shell; and
filling said interior cavity with thermal insulation material while drawing a vacuum on said interior cavity.

15. A method of constructing a water heater comprising the following steps:
providing a generally cylindrical inner water tank;
providing a generally cylindrical double-walled plastic outer shell with a sealed-closed interior cavity between said walls;
placing said inner water tank within said shell; and
filling said interior cavity with thermal insulation material while drawing a vacuum on said interior cavity.

16. A water heater comprising:
a generally cylindrical, inner water tank;
a generally cylindrical, outer shell disposed circumferentially around and spaced outwardly from said inner water tank and defining with said inner water tank an annular clearance space between the outer surface of said inner water tank and the inner surface of said outer shell;
enclosing means cooperatively arranged with said outer shell and with said inner water tank so as to seal closed said annular clearance space, said annular clearance space having insulation material disposed therein and said clearance space maintained at a negative pressure; and
said inner water tank including a generally cylindrical body which is open at its lower end and wherein said enclosing means includes a base panel formed with a generally cylindrical receiving channel sized and arranged to receive the lower end of said inner water tank.

17. A method of constructing a water heating comprising the following steps:
providing a generally cylindrical inner water tank;
providing a generally cylindrical double-walled plastic outer shell with a sealed-closed interior cavity between said walls.

18. A water heater comprising:
a generally cylindrical inner water tank; and
a generally cylindrical, outer shell disposed circumferentially around said inner water tank, said outer shell including:
a spaced-apart pair of generally concentric, generally cylindrical walls defining an annular space therebetween; and
enclosing means disposed at each end as part of said outer shell and cooperatively arranged with said pair of generally cylindrical walls so as to seal closed said annular space, said annular space being filled with insulation material.

19. A water heater comprising:
a generally cylindrical inner water tank; and
a generally cylindrical, outer shell disposed circumferentially around said inner water tank, said outer shell including:
a spaced apart pair of generally concentric, generally cylindrical walls defining an annular space therebetween; and
enclosing means disposed at each end as part of said outer shell and cooperatively arranged with said pair of generally cylindrical walls so as to seal closed said annular space, said annular space maintained at a negative pressure.

20. A water heater comprising:
a generally cylindrical inner water tank; and
a generally cylindrical, outer shell disposed circumferentially around said inner water tank, said outer shell including:
a spaced apart pair of generally concentric, generally cylindrical walls defining an annular space therebetween; and
enclosing means disposed at each end as part of said outer shell and cooperatively arranged with said pair of generally cylindrical walls so as to seal closed said annular space, said annular space having insulation material disposed therein and said annular space maintained at a negative pressure.

21. A liquid storage container comprising:
a generally cylindrical, inner liquid storage tank;
a generally cylindrical, outer shell disposed circumferentially around and spaced outwardly from said inner liquid storage tank and defining with said inner liquid storage tank an annular clearance space between the outer surface of said inner liquid storage tank and the inner surface of said outer shell;
enclosing means cooperatively arranged with said outer shell and with said inner liquid storage tank so as to seal closed said annular clearance space, said annular clearance space maintained at a negative pressure;
said outer shell including a lower edge and an upper open end and said enclosing means including a base panel integral with the lower edge of said outer shell and a top cover disposed over the upper open end of said outer shell; and
said inner liquid storage tank including a generally cylindrical body which is open at its upper end and wherein said top cover includes a generally cylindrical receiving channel which is sized and arranged to receive the upper end of said inner liquid storage tank.

22. A liquid storage container comprising:
a generally cylindrical, inner liquid storage tank;
a generally cylindrical, outer shell disposed circumferentially around and spaced outwardly from said inner liquid storage tank and defining with said inner liquid storage tank an annular clearance space between the outer surface of said inner liquid storage tank and the inner surface of said outer shell;
enclosing means cooperatively arranged with said outer shell and with said inner liquid storage tank so as to seal closed said annular clearance space, said annular clearance space maintained at a negative pressure;
said outer shell including a generally cylindrical body and molded integrally therewith as a single unit a generally circular base panel; and
said inner liquid storage tank being open at its upper end and said outer shell being open at its upper end and wherein said enclosing means further includes a top cover arranged with inner and outer, generally concentric, generally cylindrical receiving channels, said outer channel sized and arranged to receive the upper end of said outer shell and said inner channel sized and arranged to receive the upper end of said inner liquid storage tank.

23. A liquid storage container comprising:
a generally cylindrical inner liquid storage tank;
a generally cylindrical, outer shell disposed circumferentially around and spaced outwardly from said inner liquid storage tank and defining with said inner liquid storage tank an annular clearance space between the outer surface of said inner liquid storage tank and the inner surface of said outer shell;

enclosing means cooperatively arranged with said outer shell and with said inner liquid storage tank so as to seal closed said annular clearance space, said annular clearance space maintained at a negative pressure;

said inner liquid storage tank including a generally cylindrical body which is open at its lower end and wherein said enclosing means includes a base panel formed with a generally cylindrical receiving channel sized and arranged to receive the lower end of said inner liquid storage tank.

24. A liquid storage container comprising:

a generally cylindrical inner liquid storage tank;

a generally cylindrical outer shell disposed circumferentially around and spaced outwardly from said inner liquid storage tank and defining with said inner liquid storage tank an annular clearance space between the outer surface of said inner liquid storage tank and the inner surface of said outer shell;

enclosing means cooperatively arranged with said outer shell and with said inner liquid storage tank so as to seal closed said annular clearance space, said annular clearance space maintained at a negative pressure; and said inner liquid storage tank being open at its upper end and said outer shell being open at its upper end and wherein said enclosing means further includes a top cover arranged with inner and outer, generally concentric, generally cylindrical receiving channels, said outer channel sized and arranged to receive the upper end of said outer shell and said inner channel sized and arranged to receive the upper end of said inner liquid storage tank.

25. A liquid storage container comprising:

a generally cylindrical inner liquid storage tank;

an enclosed outer shell disposed around and spaced apart from said inner liquid storage tank, said outer shell including:

a generally cylindrical body portion having a generally circular upper edge and coaxial therewith a generally circular lower edge;

a lower enclosing panel disposed beneath the bottom surface of said inner liquid storage tank and joined to the lower edge of said body portion; and an upper enclosing panel arranged as a hollow cover is disposed over the top surface of said inner liquid storage tank and joined to the upper edge of said body portion;

said outer shell and said inner liquid storage tank cooperatively arranged to define a sealed clearance space therebetween, said clearance space maintained at a negative pressure; and said hollow cover includes a generally cylindrical channel disposed in alignment with the upper edge of said body portion.

26. A liquid storage container comprising:

a generally cylindrical inner liquid storage tank;

a generally cylindrical outer shell disposed circumferentially around and spaced outwardly from said inner liquid storage tank and defining with said inner liquid storage tank an annular clearance space between the outer surface of said inner liquid storage tank and the inner surface of said outer shell;

enclosing means cooperatively arranged with said outer shell and with said inner liquid storage tank so as to seal closed said annular clearance space;

said outer shell including a lower edge and an upper open end and said enclosing means including a base panel integral with the lower edge of said outer shell and a top cover disposed over the upper open end of said outer shell; and said inner liquid storage tank including a generally cylindrical body which is open at its upper end and wherein said top cover includes a generally cylindrical receiving channel which is sized and arranged to receive the upper end of said inner liquid storage tank.

27. A liquid storage container comprising:

a generally cylindrical inner liquid storage tank;

a generally cylindrical outer shell disposed circumferentially around and spaced outwardly from said inner liquid storage tank and defining with said inner liquid storage tank an annular clearance space between the outer surface of said inner liquid storage tank and the inner surface of said outer shell;

enclosing means cooperatively arranged with said outer shell and with said inner liquid storage tank so as to seal closed said annular clearance space;

said outer shell including a lower edge and an upper open end and said enclosing means including a base panel integral with the lower edge of said outer shell and a top cover disposed over the upper open end of said outer shell; and said inner liquid storage tank being open at its upper end and said outer shell being open at its upper end and wherein said enclosing means further includes a top cover arranged with inner and outer, generally concentric, generally cylindrical receiving channels, said outer channel sized and arranged to receive the upper end of said outer shell and said inner channel sized and arranged to receive the upper end of said inner liquid storage tank.

28. A liquid storage container comprising:

a generally cylindrical inner liquid storage tank;

a generally cylindrical outer shell disposed circumferentially around and spaced outwardly from said inner liquid storage tank and defining with said inner liquid storage tank an annular clearance space between the outer surface of said inner liquid storage tank and the inner surface of said outer shell; and enclosing means cooperatively arranged with said outer shell and with said inner liquid storage tank so as to seal closed said annular clearance space, said enclosing means including a hollow disc and a plug received by said inner liquid storage tank.

29. A liquid storage container comprising:

a generally cylindrical, inner storage receptacle having a closing base portion and a closing top portion;

a generally cylindrical, molded plastic outer shell disposed circumferentially around and spaced outwardly from said inner storage receptacle and defining with said inner storage receptacle an annular clearance space between the outer surface of said inner storage receptacle and the inner surface of said outer shell, said outer shell having a closed base and a top opening, said closed base being spaced apart from the closing base portion of said inner storage receptacle; and enclosing means cooperatively arranged with said outer shell so as to seal closed said annular clearance space, said enclosing means being spaced apart from the closing top portion of said inner storage receptacle and said annular clearance space having insulation material disposed therein and said annular clearance space maintained at a negative pressure.

30. A method of constructing a water heater comprising the following steps:

providing a generally cylindrical inner water tank;

providing a generally cylindrical plastic outer shell of a diameter size larger than the outside diameter of said inner water tank;

placing said inner water tank within said shell so as to define an annular clearance space between said tank and said shell; and filling said annular clearance space with thermal insulation material while drawing a vacuum on said annular clearance space.

* * * * *

UNITED STATES PATENT AND TRADEMARK OFFICE

CERTIFICATE OF CORRECTION

PATENT NO. : 4,974,551

DATED : December 4, 1990

INVENTOR(S) : Thomas E. Nelson

It is certified that error appears in the above-identified patent and that said Letters Patent is hereby corrected as shown below:

Column 23, line 35, change "heating" to --heater--.

Signed and Sealed this

Twentieth Day of April, 1993

*Attest:*

MICHAEL K. KIRK

*Attesting Officer*

*Acting Commissioner of Patents and Trademarks*